US007916082B1

(12) United States Patent
Herting

(10) Patent No.: US 7,916,082 B1
(45) Date of Patent: Mar. 29, 2011

(54) FIELD COMPATIBLE ESA CALIBRATION METHOD

(75) Inventor: Brian J. Herting, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 174 days.

(21) Appl. No.: 12/454,504

(22) Filed: May 19, 2009

(51) Int. Cl.
*H01Q 3/00* (2006.01)

(52) U.S. Cl. ..... 342/368

(58) Field of Classification Search ..... 342/368
See application file for complete search history.

(56) References Cited

U.S. PATENT DOCUMENTS 5,721,554 A * 2/1998 Hall et al. ..... 342/165
6,771,216 B2 * 8/2004 Patel et al. ..... 342/368
7,327,313 B2 * 2/2008 Hemmi et al. ..... 342/368
2009/0066727 A1 * 3/2009 Lu et al. ..... 345/643

* cited by examiner

*Primary Examiner* — Thomas H Tarcza
*Assistant Examiner* — Harry Liu
(74) *Attorney, Agent, or Firm* — Matthew J. Evens; Daniel M. Barbieri

(57) ABSTRACT

A method may include cycling a first beam steering control antenna element of an electronically scanned antenna (ESA) array through a first portion of beam steering control states for the first beam steering control antenna element. The first beam steering control antenna element is probed while cycling the first beam steering control antenna element through the first portion of beam steering control states. A first amplitude and a first phase for energy coupled from the ESA array to a probe are recorded for each one of the first portion of beam steering control states. The recorded first amplitude and the recorded first phase are separated into a first component and a second component. The phase of the first beam steering control antenna element is determined utilizing the first component and the second component.

19 Claims, 8 Drawing Sheets

FIELD COMPATIBLE ESA CALIBRATION METHOD

TECHNICAL FIELD

The present disclosure generally relates to the field of antenna arrays, and more particularly to a method for calibrating an electronically scanned antenna array.

BACKGROUND

Electronically Scanned Antenna (ESA) arrays may require lengthy and costly calibration schemes that are typically not easy to deploy in a field environment. For example, traditional calibration schemes may require characterization of individual sub-components before final integration, as well as requiring minor adjustments during final testing and verification in a near-field antenna measurement range. Characterizing the sub-components may cause lengthy test times. Additionally, it may be difficult to measure certain components. Alternatively, the completed antenna may be characterized in a near-field antenna measurement range with no a priori information regarding the sub-components. This may be difficult to accomplish due to mutual coupling and typically requires lengthy calibration and test times.

SUMMARY

A method may include cycling a first beam steering control antenna element of an electronically scanned antenna (ESA) array through a first portion of a first set of beam steering control states for the first beam steering control antenna element. Then, the first beam steering control antenna element is probed while cycling the first beam steering control antenna element through the first portion of the first set of beam steering control states. Next, a first amplitude and a first phase for the electric field coupled from the ESA array to a probe are recorded for each one of the first portion of the first set of beam steering control states. Then, the recorded first amplitude and the recorded first phase are separated into a first component and a second component. Next, the amplitude and phase of the first beam steering control antenna element are determined for each one of the first portion of the first set of beam steering control states utilizing the first component and the second component. Then, the first amplitude as a function of phase state for the first beam steering control antenna element is verified. A second beam steering control antenna element of the ESA array is cycled through a first portion of a second set of beam steering control states for the second beam steering control antenna element. Then, the second beam steering control antenna element is probed while cycling the second beam steering control antenna element through the first portion of the second set of beam steering control states. Next, a second amplitude and a second phase for the electric field coupled from the ESA array to the probe are recorded for each one of the first portion of the second set of beam steering control states. Then, the recorded second amplitude and the recorded second phase are separated into a third component and a fourth component. Next, the amplitude and phase of the second beam steering control antenna element are determined for each one of the first portion of the second set of beam steering control states utilizing the third component and the fourth component. A difference between a first amplitude as a function of phase state for the first beam steering control antenna element and a second amplitude as a function of phase state for the second beam steering control antenna element is calculated. Then, the second amplitude as a function of phase state for the second beam steering control antenna element is verified. Next, a calibration table for the ESA array is compiled.

A method may include iteratively computing a calibration table for an electronically scanned antenna (ESA) array having a number of beam steering control antenna elements. The calibration table may be repeatedly computed until a maximum phase error for each one of the beam steering control antenna elements is less than a predetermined maximum phase error value. First, the calibration table is utilized to generate a specific beam. Next, a near field scan of the ESA is captured. Then, a phase of a hologram at the face of the ESA aperture is analyzed. Finally, a phase control for one of the beam steering control antenna elements is adjusted when a phase error of the beam steering control antenna element exceeds the predetermined maximum phase error value.

A method may include cycling a first beam steering control antenna element of an electronically scanned antenna (ESA) array through a first portion of a first set of beam steering control states for the first beam steering control antenna element. Then, the first beam steering control antenna element is probed while cycling the first beam steering control antenna element through the first portion of the first set of beam steering control states. Next, a first amplitude and a first phase for the electric field coupled from the ESA array to a probe are recorded for each one of the first portion of the first set of beam steering control states. Then, the recorded first amplitude and the recorded first phase are separated into a first component and a second component. Next, the amplitude and phase of the first beam steering control antenna element are determined for each one of the first portion of the first set of beam steering control states utilizing the first component and the second component. Then, the first amplitude as a function of phase state for the first beam steering control antenna element is verified. A second beam steering control antenna element of the ESA array is cycled through a first portion of a second set of beam steering control states for the second beam steering control antenna element. Then, the second beam steering control antenna element is probed while cycling the second beam steering control antenna element through the first portion of the second set of beam steering control states. Next, a second amplitude and a second phase for the electric field coupled from the ESA array to the probe are recorded for each one of the first portion of the second set of beam steering control states. Then, the recorded second amplitude and the recorded second phase are separated into a third component and a fourth component. Next, the amplitude and phase of the second beam steering control antenna element are determined for each one of the first portion of the second set of beam steering control states utilizing the third component and the fourth component. Then, the second amplitude as a function of phase state for the second beam steering control antenna element is verified. Next, a calibration table for the ESA array is compiled. The calibration table is utilized to generate a specific beam. Next, a near field scan of the ESA is captured. Then, a phase of a hologram at the face of the ESA aperture is analyzed. Next, a phase control for one or both of the first beam steering control antenna element and the second beam steering control antenna element is adjusted when a phase error of the beam steering control antenna element exceeds the predetermined maximum phase error value. Near field scans of the ESA array are taken and phase control adjustments are made until all phase errors are less than the predetermined maximum phase error value. Finally, the calibration table for the ESA array is modified as necessary to reflect changes made to any of the phase controls for the antenna elements.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

Figure 1A:
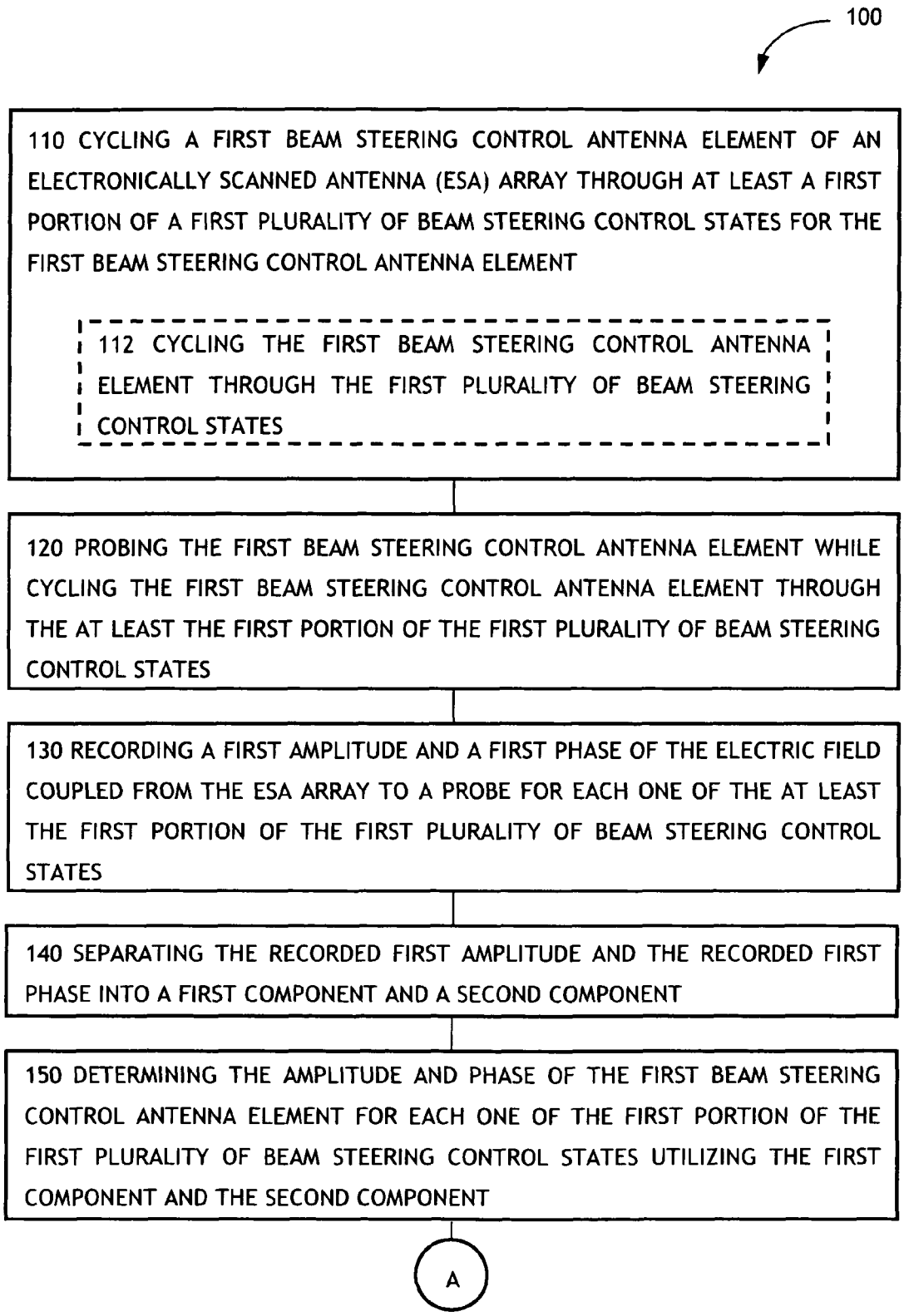
FIG. 1 is a method for calibrating an electronically scanned antenna (ESA) array in accordance with the present disclosure.
Figure 1B:
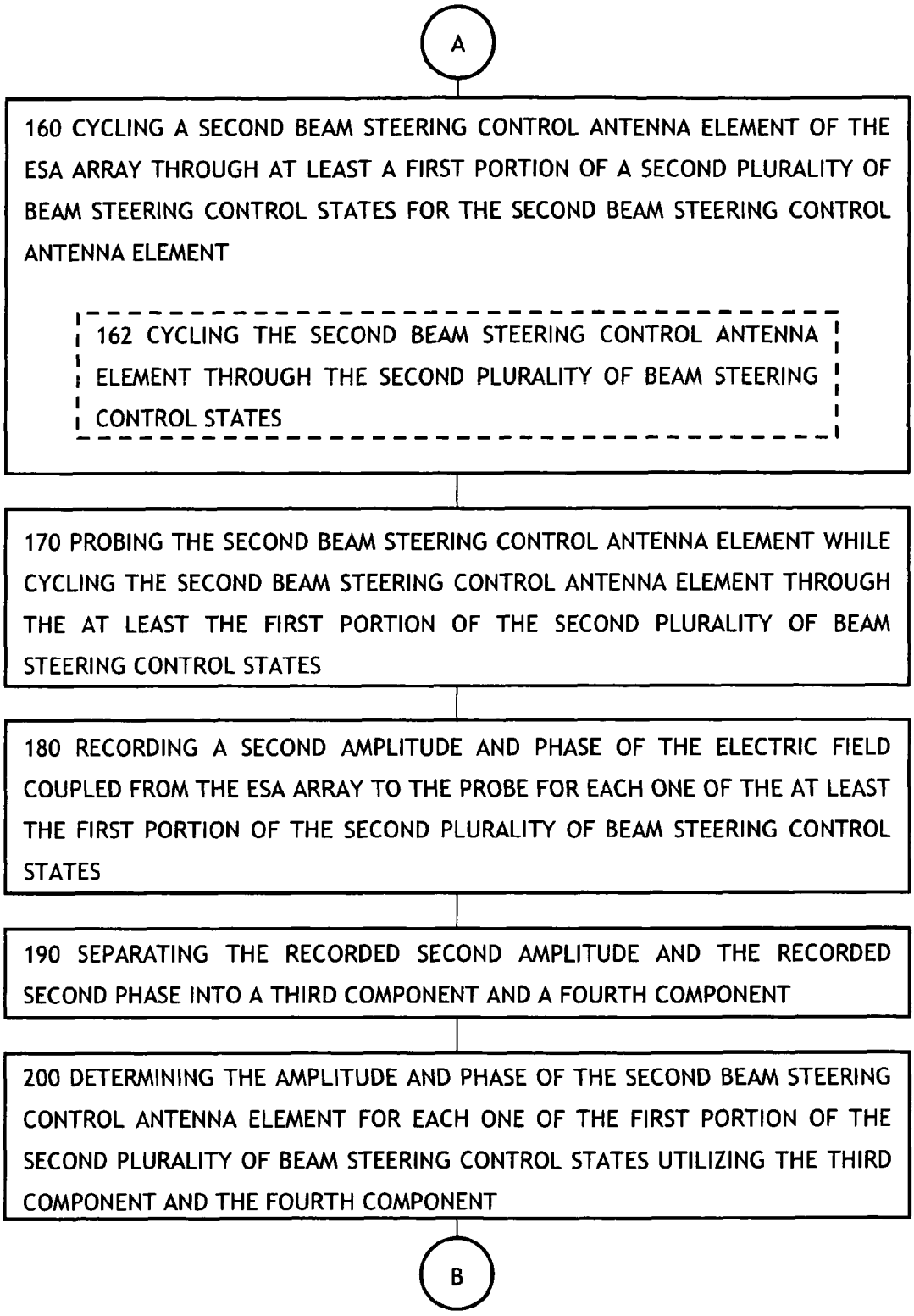
Figure 1C:
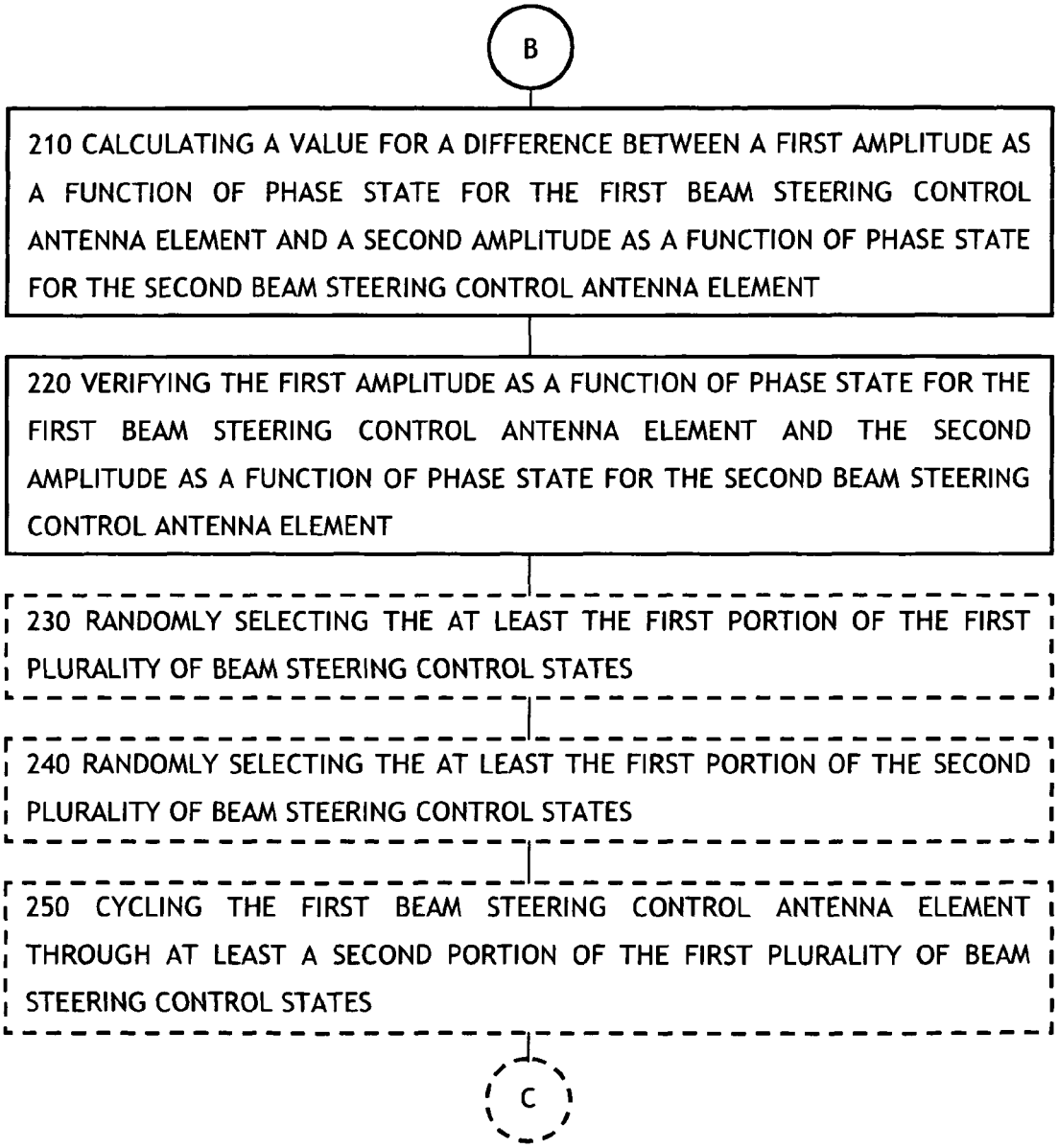

Referring to FIG. 1, a method 100 for calibrating an electronically scanned antenna (ESA) array is described in accordance with the present disclosure. The ESA array may be calibrated by placing a probe in one or more locations in front of the ESA aperture and then measuring the amplitude and phase of each beam steering control antenna element. In embodiments, a near-field range may not be required; only a probe placed some distance in front of the ESA radiating aperture. It will be appreciated that the probe may be positioned in front of each beam steering control antenna element, or alternatively, could remain in one place (or be moved to certain discrete locations in front of the ESA). In embodiments where the probe is relatively stationary with respect to the ESA array, it will be appreciated that calibration may be utilized to account for differences in path lengths to the probe for the various elements in the array.

Figure 3:
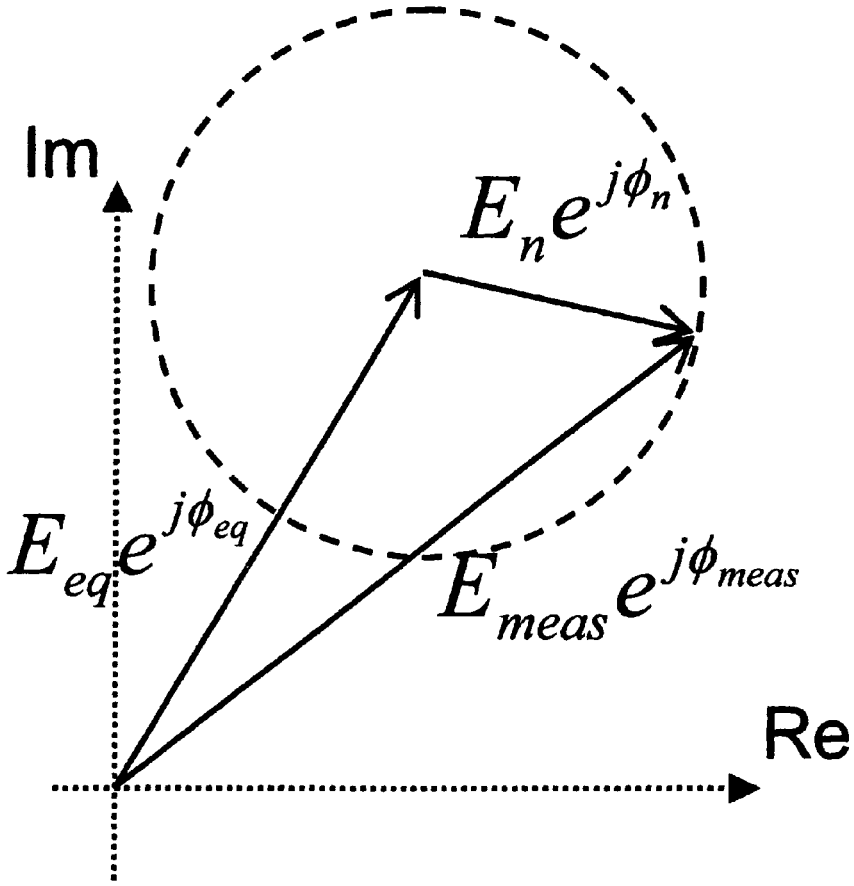
FIG. 3 is a schematic illustrating a calibration for a beam steering control antenna element.
Figure 4:
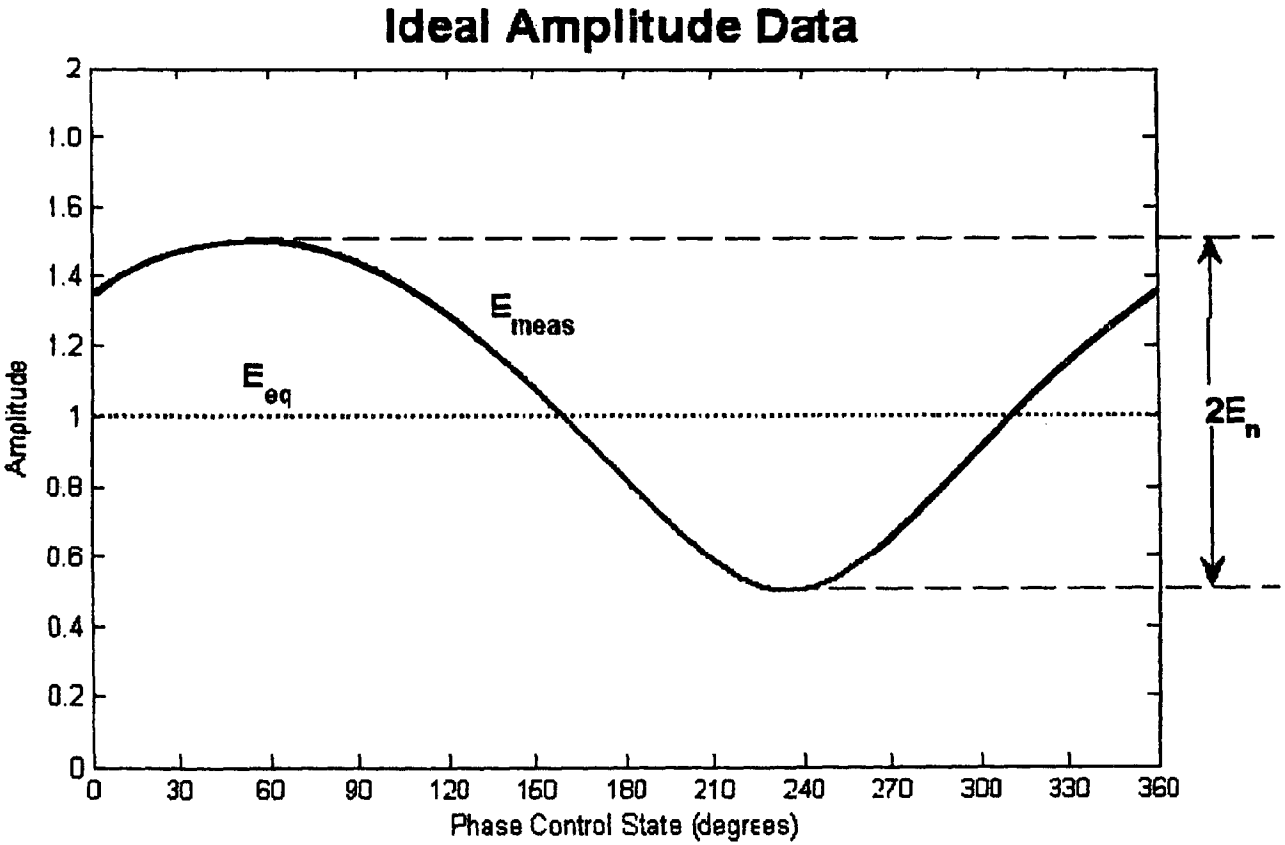
FIG. 4 is a graph illustrating ideal amplitude data for a beam steering control antenna element.
Figure 5:
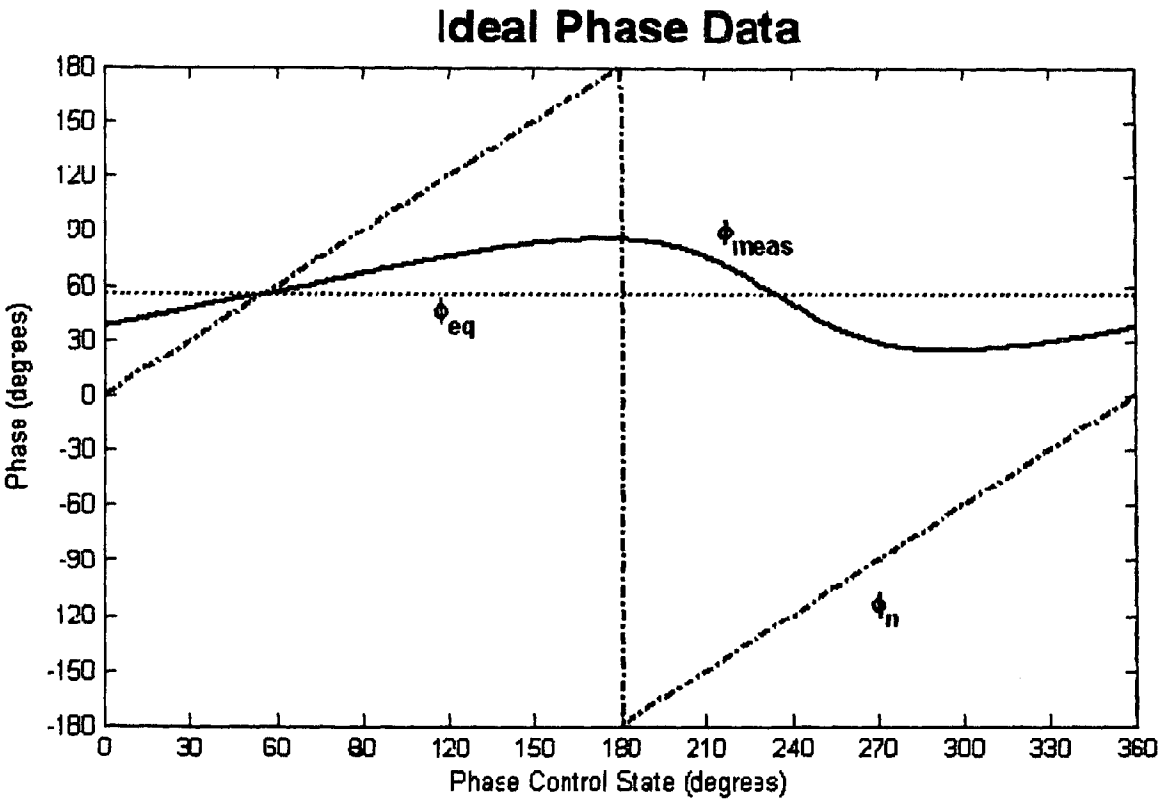
FIG. 5 is a graph illustrating ideal phase data for a beam steering control antenna element.

A first beam steering control antenna element of the ESA array is cycled through a first portion of a first set of possible beam steering control states for the first, beam steering control antenna element, 110. In one embodiment, the first beam steering control antenna element may be cycled through all possible beam steering control states, 112. Then, the first beam steering control antenna element is probed while cycling the first beam steering control antenna element through the first portion of the first set of possible beam steering control states, 120. Next, a first amplitude ($E_{meas}$) and a first phase ($\phi_{meas}$) of the electric field coupled from the ESA array to a probe are recorded for each one of the first portion of the first set of possible beam steering control states, 130. The amplitude as a function of phase state should exhibit a distinct maximum ($E_{meas,max}$) and minimum ($E_{meas,min}$). Then, the recorded first amplitude and the recorded first phase are separated into a first component and a second component, 140. Next, the amplitude and phase of the first beam steering control antenna element is determined for each one of the first portion of the first set of possible beam steering control states utilizing the first component and the second component, 150. For example (with reference to FIGS. 3 through 5):

$$E_{meas}e^{j\phi_{meas}} = E_n e^{j\phi_n} + E_{eq}e^{j\phi_{eq}}, \text{ where } E_{eq}e^{j\phi_{eq}} = \sum_{\substack{m=1\\ m\neq n}}^{N} E_m e^{j\phi_m}$$

$$\left.\begin{aligned} E_{meas,min} &= E_{eq} - E_n \\ E_{meas,max} &= E_{eq} + E_n \end{aligned}\right\} \quad E_n = \frac{(E_{meas,max} - E_{meas,min})}{2} \text{ and } E_{eq} = \frac{(E_{meas,max} + E_{meas,min})}{2}$$

$$\phi_{eq} = \phi_{meas}\,|_{E_{meas}=E_{meas,max}}$$

$\therefore E_n e^{j\phi_n} = E_{meas}e^{j\phi_{meas}} - E_{eq}e^{j\phi_{eq}}$ for all beam steering control states; where $E_{meas}e^{j\phi,meas}$ represents the total measured electric field, $E_{eq}e^{j\phi,eq}$ is a constant representing the portion of the total measured electric field due to radiation from other array elements (i.e., not radiation from the $n^{th}$ element being calibrated), and $E_n e^{j\phi,n}$ represents the portion of the total measured electric field due to radiation from the $n^{th}$ element. In one embodiment, $\phi_n$ is swept over at least a modulo of 360 degrees by cycling the electronic beam steering control for the $n^{th}$ element through a portion or all of its states.

A second beam steering control antenna element of the ESA array is cycled through a first portion of a second set of possible beam steering control states for the second beam steering control antenna element, 160. In one embodiment, the second beam steering control antenna element may be cycled through all possible beam steering control states, 162. Then, the second beam steering control antenna element is probed while cycling the second beam steering control antenna element through the first portion of the second set of possible beam steering control states, 170. Next, a second amplitude and a second phase of the electric field coupled from the ESA array to the probe are recorded for each one of the first portion of the second set of possible beam steering control states, 180. Then, the recorded second amplitude and the recorded second phase are separated into a third component and a fourth component, 190. Next, the amplitude and phase of the second beam steering control antenna element is determined for each one of the first portion of the second set of possible beam steering control states utilizing the third component and the fourth component, 200.

A difference between a first amplitude as a function of phase state for the first beam steering control antenna element is calculated. In an embodiment, the difference may be calculated as an absolute value of the difference between the first amplitude as a function of phase state for the first beam steering control antenna element. Also, a difference between a second amplitude as a function of phase state for the second beam steering control antenna element is calculated, 210. In an embodiment, the difference may be calculated as an absolute value of the difference between the second amplitude as a function of phase state for the second beam steering control antenna element. Then, the first amplitude as a function of phase state for the first beam steering control antenna element is verified. Also, the second amplitude as a function of phase state for the second beam steering control antenna element is verified, 220.

To verify the first calculated amplitude and phase as a function of phase state for the first beam steering control antenna element, a validity check is performed based upon the calculated amplitude for the first beam steering control antenna element, which, assuming the insertion loss of the first antenna control element as a function of phase state is substantially constant, should be equal to at least substantially one-half the difference between the maximum and minimum amplitude recorded for the first portion of the first set of possible beam steering control states. If the validity check does not meet a predefined criteria (e.g., when the difference is less than or equal to a pre-established error limit), all or a portion of the states for each of the beam steering control antenna elements in the array are changed, and the process described above is repeated (e.g., method 100, steps 110, 120, 130, 140, and 150). Upon satisfying the predefined criteria of the validity check, a second beam steering control element may be calibrated, as previously described.

To verify the second calculated amplitude and phase as a function of phase state for the second beam steering control antenna element, a validity check is performed based upon the calculated amplitude for the second beam steering control antenna element, which, assuming the insertion loss of the second antenna control element as a function of phase state is substantially constant, should be equal to at least substantially one-half the difference between the maximum and minimum amplitude recorded for the first portion of the second set of possible beam steering control states. If the validity check does not meet a predefined criteria (e.g., when the difference is less than or equal to a pre-established error limit), all or a portion of the states for each of the beam steering control antenna elements in the array are changed, and the process described above is repeated (e.g., method 100, steps 160, 170, 180, 190, and 200). Upon satisfying the predefined criteria of the validity check, a third beam steering control element may be calibrated; or, if there exists no further beam steering control antenna elements, calibration is complete.

In one embodiment, the first portion of the first set of beam steering control states for the first beam steering control antenna element may be randomly selected, 230. In another embodiment, the first portion of the second set of beam steering control states for the second beam steering control antenna element may be randomly selected, 240. In a still further embodiment, the first beam steering control antenna element may be cycled through at least a second portion of the first set of possible beam steering control states, 250. (Alternatively, the second beam steering control antenna element may be cycled through at least a second portion of the second set of possible beam steering control states.) It will be appreciated that this process (e.g., method 100, steps 120, 130, 140, 150, 170, 180, 190, 200, 210, 220, and 250) may be repeated until the difference between the amplitude as a function of phase state for every combination of two beam steering control antenna elements is less than or equal to the pre-established error limit.

Figure 2:
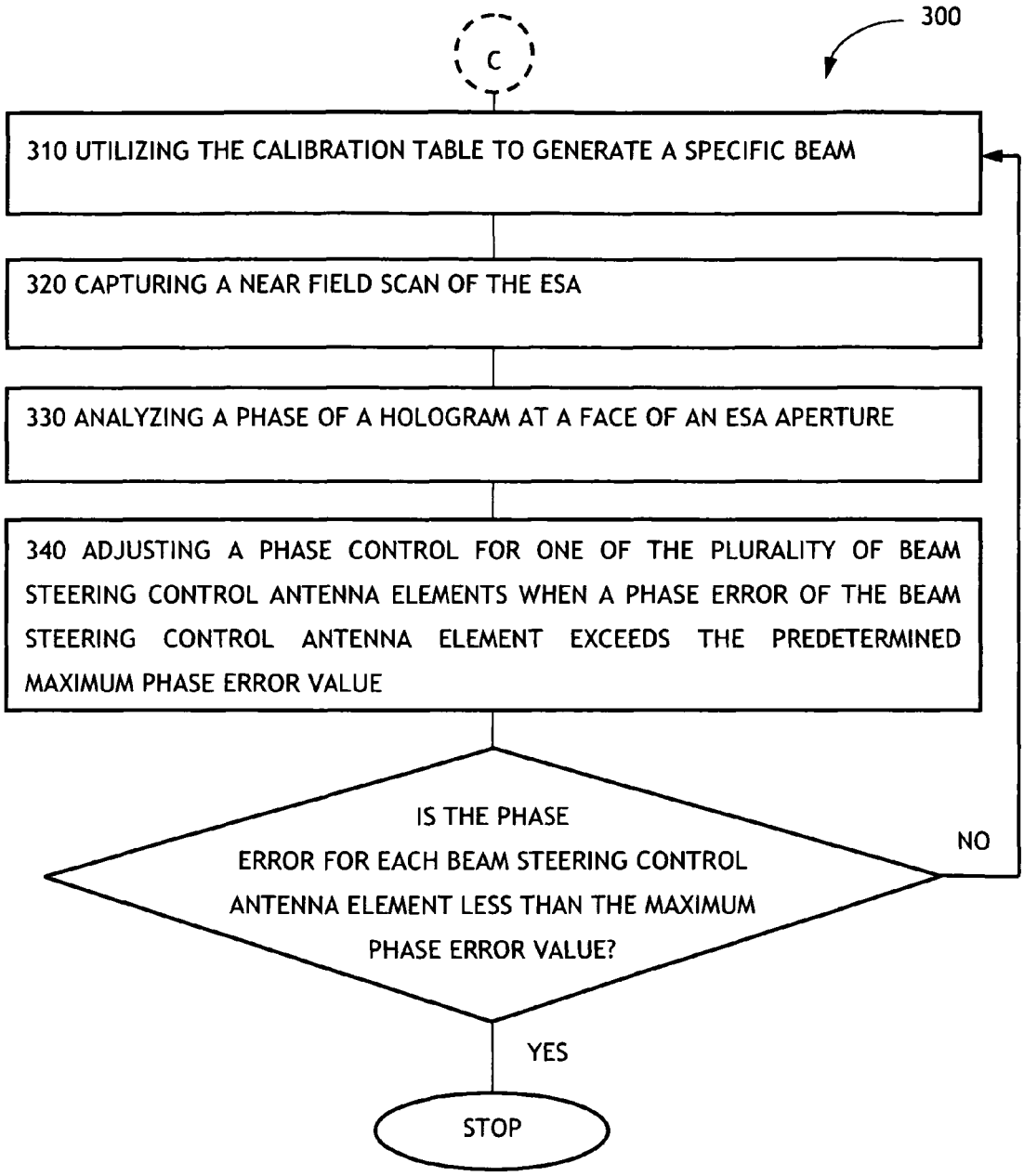
FIG. 2 is a method for generating a calibration table for an ESA array in accordance with the present disclosure.

Referring now to FIG. 2, a method 300 for generating a calibration table for an electronically scanned antenna (ESA) array is described in accordance with the present disclosure. In one embodiment, the calibration table for the ESA array is computed utilizing the first calculated amplitude and phase as a function of phase state for the first beam steering control antenna element and the second calculated amplitude and phase as a function of phase state for the second beam steering control antenna element, which are determined as previously described (e.g., method 100, steps 110-200). In a second embodiment, the calibration table is utilized to generate a specific beam, 310. In one embodiment, the specific beam may comprise a boresite beam with equiphase across the ESA aperture. Next, a near field scan of the ESA is captured, 320. Then, a phase of a hologram at the face of the ESA aperture is analyzed, 330. Finally, a phase control for one of the beam steering control antenna elements (e.g., the first beam steering control antenna element and/or the second beam steering control antenna element as described in FIG. 1) is adjusted when a phase error of the beam steering control antenna element exceeds the predetermined maximum phase error value, 340. The process described above is repeated (e.g., method 300, steps 310, 320, 330, and 340) until the phase error for each beam steering control element is less than the predetermined maximum phase error value. In embodiments, the calibration table may be computed for one or more different frequencies.

Figure 6:
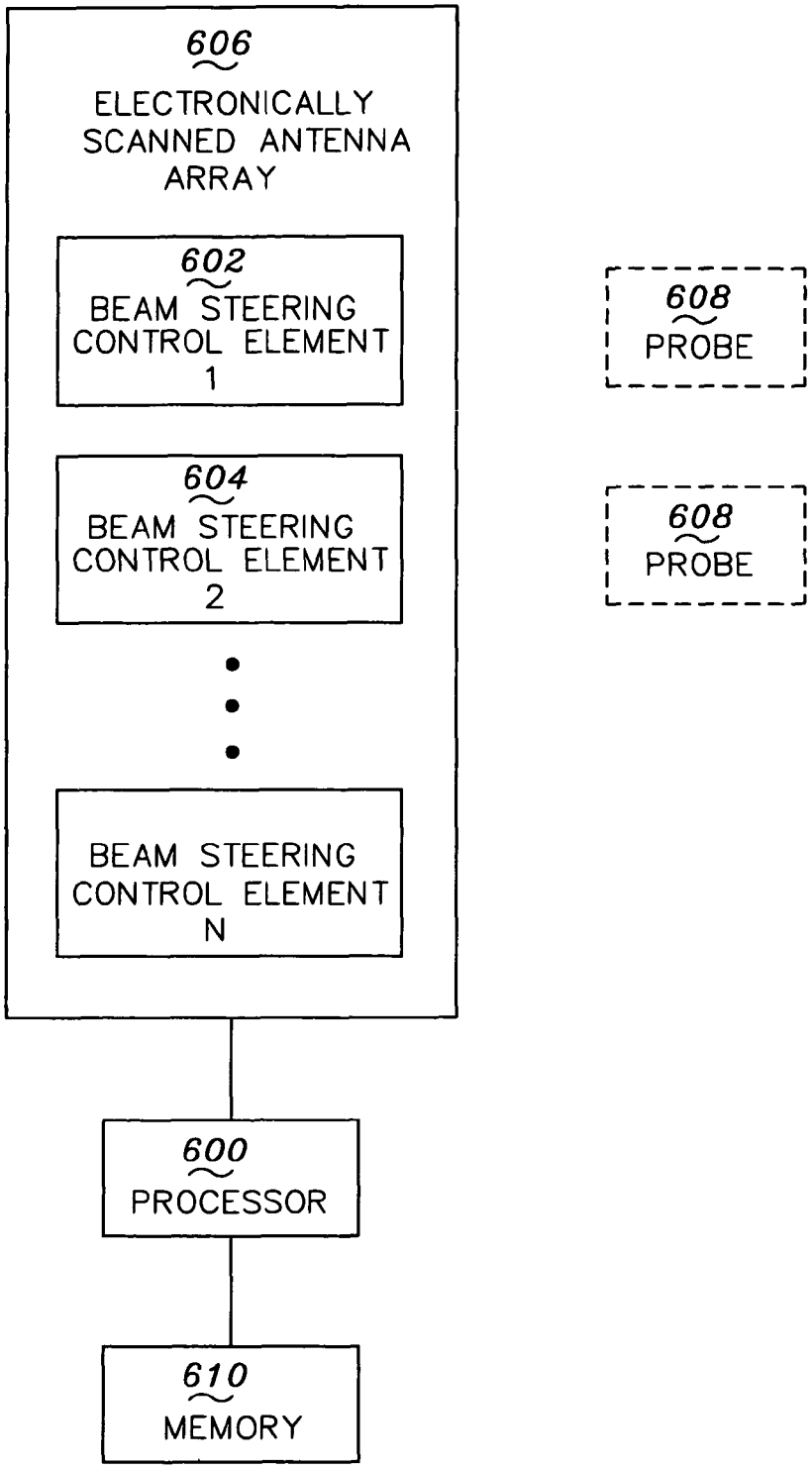
FIG. 6 is a block diagram of a system for calibrating an electronically scanned antenna (ESA) array in accordance with the present disclosure.

Referring now to FIG. 6, a processor 600 may be utilized to steer a first beam steering control element 602 and/or a second beam steering control element 604 of an ESA array 606. The processor 600 may execute one or more instructions corresponding to the accompanying method steps illustrated in FIGS. 1 and 2 and/or described herein. The one or more instructions may be, for example, computer executable and/or logic-implemented instructions stored in memory 610. In one embodiment, the processor 600 may be utilized to calibrate the ESA array 606 while a probe 608 is placed in one or more locations in front of the ESA aperture and the amplitude and phase of each beam steering control antenna element is measured. Further, the results of the calibration and/or the instructions corresponding to the methods of the present disclosure may be stored in an accompanying memory 610. The memory may comprise a signal-bearing medium. In one implementation, the signal-bearing medium may include a computer-readable medium. In one implementation, the signal bearing medium may include a recordable medium. In one implementation, the signal bearing medium may include a communications medium. Processor 600 and memory 610 may be implemented in a computing device.

In the present disclosure, the methods disclosed may be implemented as sets of instructions or software readable by a device. Further, it is understood that the specific order or hierarchy of steps in the methods disclosed are examples of exemplary approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A method, comprising:

cycling a first beam steering control antenna element of an electronically scanned antenna (ESA) array through at least a first portion of a first set of beam steering control states for the first beam steering control antenna element;

probing the first beam steering control antenna element while cycling the first beam steering control antenna element through the at least the first portion of the first set of beam steering control states;

recording a first amplitude and a first phase for the electric field coupled from the ESA array to a probe for each one of the at least the first portion of the first set of beam steering control states;

separating the recorded first amplitude and the recorded first phase into a first component and a second component;

determining the amplitude and phase of the first beam steering control antenna element for each one of the first portion of the first set of beam steering control states utilizing the first component and the second component;

cycling a second beam steering control antenna element of the ESA array through at least a first portion of a second set of beam steering control states for the second beam steering control antenna element;

probing the second beam steering control antenna element while cycling the second beam steering control antenna element through the at least the first portion of the second set of beam steering control states;

recording a second amplitude and a second phase for the electric field coupled from the ESA array to the probe for each one of the at least the first portion of the second set of beam steering control states;

separating the recorded second amplitude and the recorded second phase into a third component and a fourth component;

determining the amplitude and phase of the second beam steering control antenna element for each one of the first portion of the second set of beam steering control states utilizing the third component and the fourth component;

calculating a difference between a first amplitude as a function of phase state for the first beam steering control antenna element and a second amplitude as a function of phase state for the second beam steering control antenna element; and verifying the first amplitude as a function of phase state for the first beam steering control antenna element and the second amplitude as a function of phase state for the second beam steering control antenna element.

2. The method of claim 1, wherein cycling the first beam steering control antenna element through the at least the first portion of the first set of beam steering control states comprises cycling the first beam steering control antenna element through the first set of beam steering control states.

3. The method of claim 1, wherein cycling the second beam steering control antenna element through the at least the first portion of the second set of beam steering control states comprises cycling the second beam steering control antenna element through the second set of beam steering control states.

4. The method of claim 1, further comprising:

randomly selecting the at least the first portion of the first set of beam steering control states.

5. The method of claim 1, further comprising:

randomly selecting the at least the first portion of the second set of beam steering control states.

6. The method of claim 1, further comprising:

cycling the first beam steering control antenna element through at least a second portion of the first set of beam steering control states.

7. The method of claim 3, further comprising:

randomly selecting the at least the second portion of the first set of beam steering control states and the at least the second portion of the second set of beam steering control states.

8. A method, comprising:

iteratively computing a calibration table for an electronically scanned antenna (ESA) array comprising a set of beam steering control antenna elements until a maximum phase error for each one of the set of beam steering control antenna elements is less than a predetermined maximum phase error value by:

utilizing the calibration table to generate a specific beam;

capturing a near field scan of the ESA;

analyzing a phase of a hologram at a face of an ESA aperture; and adjusting a phase control for one of the set of beam steering control antenna elements when a phase error of the beam steering control antenna element exceeds the predetermined maximum phase error value.

9. The method of claim 8, wherein the specific beam comprises a boresite beam with equiphase across the ESA aperture.

10. The method of claim 8, wherein the calibration table is computed for one or more different frequencies.

11. A method, comprising:

cycling a first beam steering control antenna element of an electronically scanned antenna (ESA) array through at least a first portion of a first set of beam steering control states for the first beam steering control antenna element;

probing the first beam steering control antenna element while cycling the first beam steering control antenna element through the at least the first portion of the first set of beam steering control states;

recording a first amplitude and a first phase for the electric field coupled from the ESA array to a probe for each one of the at least the first portion of the first set of beam steering control states;

separating the recorded first amplitude and the recorded first phase into a first component and a second component;

determining the amplitude and phase of the first beam steering control antenna element for each one of the first portion of the first set of beam steering control states utilizing the first component and the second component;

cycling a second beam steering control antenna element of the ESA array through at least a first portion of a second set of beam steering control states for the second beam steering control antenna element;

probing the second beam steering control antenna element while cycling the second beam steering control antenna element through the at least the first portion of the second set of beam steering control states;

recording a second amplitude and a second phase for the electric field coupled from the ESA array to the probe for each one of the at least the first portion of the second set of beam steering control states;

separating the recorded second amplitude and the recorded second phase into a third component and a fourth component;

determining the amplitude and phase of the second beam steering control antenna element for each one of the first portion of the second set of beam steering control states utilizing the third component and the fourth component;

calculating a difference between a first amplitude as a function of phase state for the first beam steering control antenna element and a second amplitude as a function of phase state for the second beam steering control antenna element;

verifying the first amplitude as a function of phase state for the first beam steering control antenna element and the second amplitude as a function of phase state for the second beam steering control antenna element;

computing a calibration table for the ESA array utilizing the first amplitude as a function of phase state for the first beam steering control antenna element and the second amplitude as a function of phase state for the second beam steering control antenna element;

iteratively computing the calibration table until a maximum phase error for each one of the first beam steering control antenna element and the second beam steering control antenna element is less than a predetermined maximum phase error value by:

utilizing the calibration table to generate a specific beam;

capturing a near field scan of the ESA;

analyzing a phase of a hologram at a face of an ESA aperture; and adjusting a phase control for at least one of the first beam steering control antenna element or the second beam steering control antenna element when a phase error of at least one of the first beam steering control antenna element or the second beam steering control antenna element exceeds the predetermined maximum phase error value.

12. The method of claim 11, wherein cycling the first beam steering control antenna element through the at least the first portion of the first set of beam steering control states comprises cycling the first beam steering control antenna element through the first set of beam steering control states.

13. The method of claim 11, wherein cycling the second beam steering control antenna element through the at least the first portion of the second set of beam steering control states comprises cycling the second beam steering control antenna element through the second set of beam steering control states.

14. The method of claim 11, further comprising:

randomly selecting the at least the first portion of the first set of beam steering control states.

15. The method of claim 11, further comprising:

randomly selecting the at least the first portion of the second set of beam steering control states.

16. The method of claim 11, further comprising:

cycling the first beam steering control antenna element through at least a second portion of the first set of beam steering control states.

17. The method of claim 16, further comprising:

randomly selecting the at least the second portion of the first set of beam steering control states and the at least the second portion of the second set of beam steering control states.

18. The method of claim 11, wherein the specific beam comprises a boresite beam with equiphase across the ESA aperture.

19. The method of claim 11, wherein the calibration table is computed for one or more different frequencies.

* * * * *